US006568613B1

(12) United States Patent
Gloor

(10) Patent No.: US 6,568,613 B1
(45) Date of Patent: May 27, 2003

(54) METHOD AND DEVICE FOR BREAKING UP BULK MATERIALS WHICH HAVE SOLIDIFIED IN A CONTAINER

(75) Inventor: Christian Gloor, Sevelen (CH)

(73) Assignee: Stag AG, Maienfeld (CH)

( * ) Notice: Subject to any disclaimer, the term of this patent is extended or adjusted under 35 U.S.C. 154(b) by 0 days.

(21) Appl. No.: 09/719,654

(22) PCT Filed: Aug. 25, 1999

(86) PCT No.: PCT/CH99/00393

§ 371 (c)(1),
(2), (4) Date: Dec. 13, 2000

(87) PCT Pub. No.: WO00/17070

PCT Pub. Date: Mar. 30, 2000

(30) Foreign Application Priority Data

Sep. 17, 1998 (CH) ..... 1897/98
Jan. 18, 1999 (EP) ..... 99100792

(51) Int. Cl.[7] ..... B02C 19/00
(52) U.S. Cl. ..... 241/30; 241/283
(58) Field of Search ..... 241/30, 283, 277, 241/199.12; 222/228, 236, 252, 406; 414/288

(56) References Cited

U.S. PATENT DOCUMENTS 2,576,620 A 11/1951 Martin 4,620,795 A * 11/1986 Diebold et al. ..... 222/228

* cited by examiner

*Primary Examiner*—Mark Rosenbaum
(74) *Attorney, Agent, or Firm*—Henry M. Feiereisen; Ursula B. Day

(57) ABSTRACT

The invention relates to a method and an apparatus for performing the method by means of which accumulations of a bunkered powdery or granular bulk material which are compacted in a silo or in the conical section (15) of a container (10) are comminuted for the discharge. A swivelling member (25) is arranged above the outlet opening (18') in the conical section (15), and on the inner wall (16') of the conical section (15) and on said swivelling member at least one, but preferably a plurality of elongated extraction elements (14) are arranged which are oriented in the direction of the conical wall (16) of the conical section (15) and are in engagement with the compacted accumulation of the filled bulk material in such a way that during a swivelling movement of the swivelling member (25) which is oriented about the vertical axis (Y) of the container the accumulation is comminuted for the discharge as a result of a frictional, scratching or excavating action. The swivelling member (25) is preferably swivellably driven back and forth about the vertical axis (Y) by a drive unit (70).

23 Claims, 6 Drawing Sheets

FIG. 4
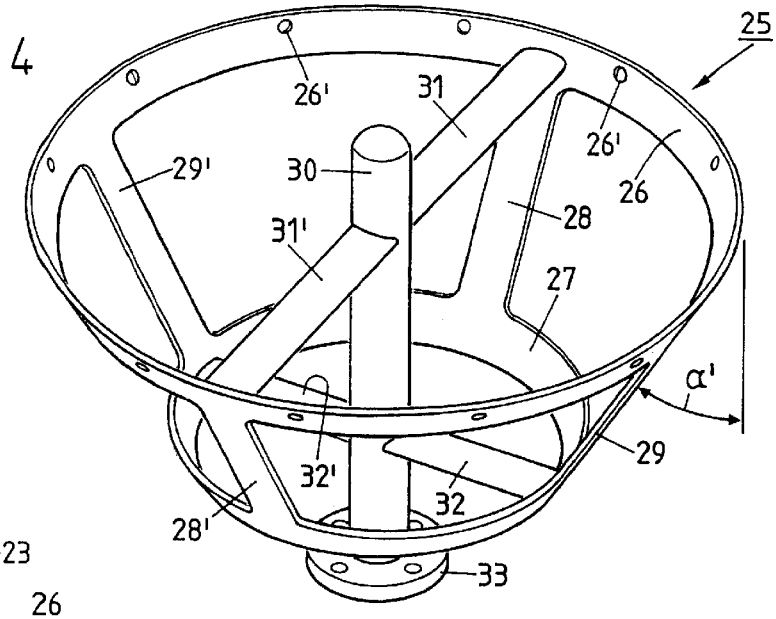
FIG. 12
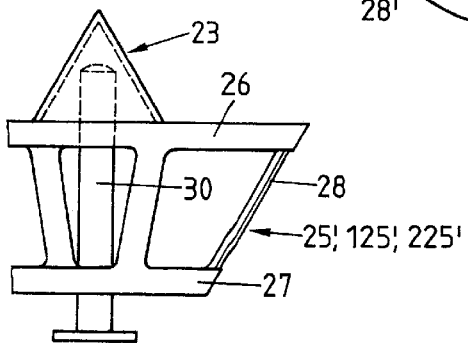
FIG. 5
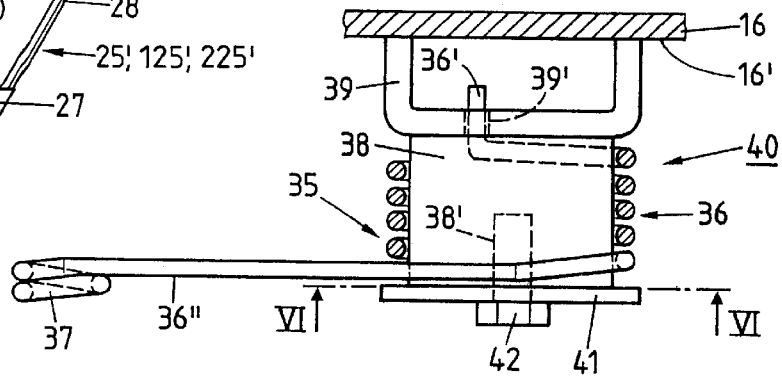
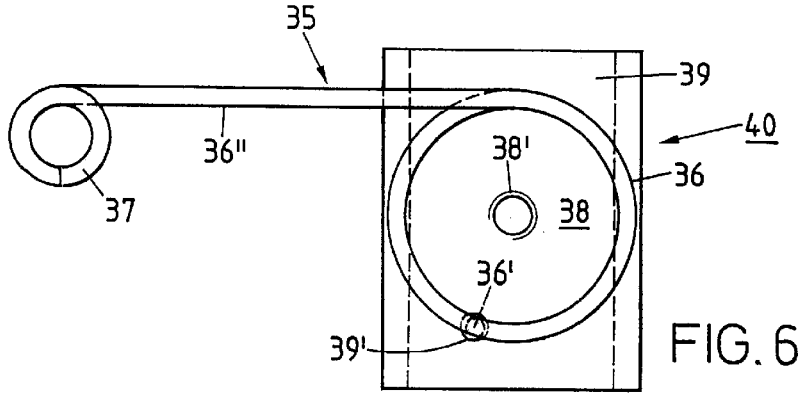
FIG. 6

FIG. 7
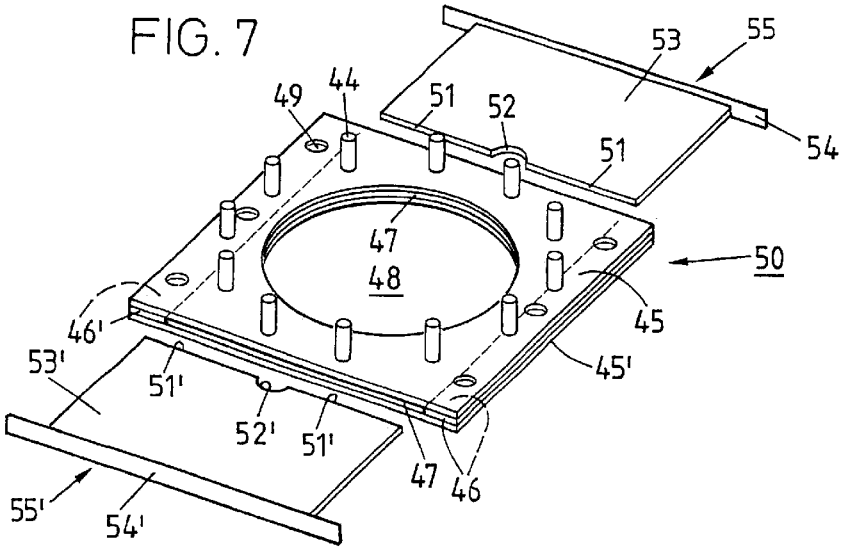
FIG. 8
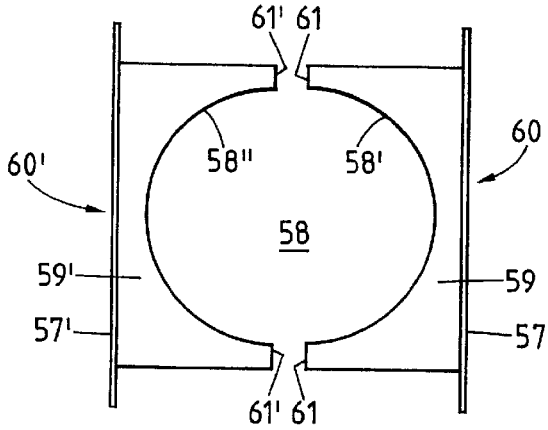
FIG. 11
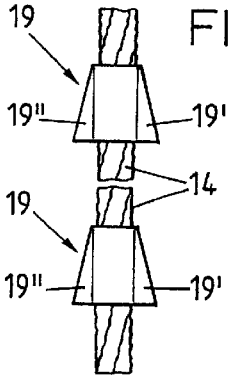
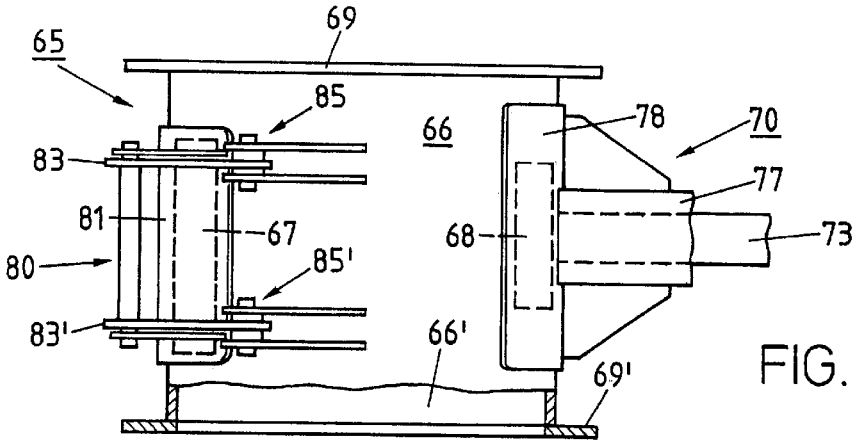
FIG. 9

METHOD AND DEVICE FOR BREAKING UP BULK MATERIALS WHICH HAVE SOLIDIFIED IN A CONTAINER

BACKGROUND OF THE INVENTION

The invention relates to a method and an apparatus for breaking up compacted accumulations of a bulk material in a container which is bunkered in form of a granular or powdery material in a container provided with an outlet opening and is discharged when required.

Containers for bunkering and discharging powdery or granular bulk materials are generally known, with containers which are generally used being provided with a section which tapers conically in the direction of the discharge opening and being provided with a discharge device which is arranged thereon and is opened and closed as required. Respective means for breaking up accumulations of material formed and compacted in the container are not provided for in the known containers.

SUMMARY OF INVENTION

The invention is based on the object of providing a method and an apparatus for performing the method by means of which it will become possible to carefully break up and remove accumulations formed in the container of the filled and compacted bulk material, so that a substantially continuous discharge of the material from the container is achieved without any quality-dependent changes to the material.

The solution in accordance with the method is achieved in such a way that in the inner chamber of the container at least one extraction element is provided which is oriented approximately in the axial direction and is arranged with the first end above and at a distance from the discharge opening on the inner wall of the container and with the other second end is operatively connected with a swivelling member arranged in the zone of discharge opening and is in engagement with the accumulations of bulk material in such a way that as a result of a movement of the swivelling member which is oriented about the vertical container axis the accumulation of bulk material is comminuted for the discharge by means of the extraction element which is moved relative to the inner wall of the container.

The apparatus for performing the method is characterized in that in the zone of the outlet opening there is provided a swivelling member which is operatively connected by way of a shaft to at least one drive unit and at least one extraction element which is arranged with the first end on the inner wall of the container and is operatively connected with the other second end with the swivelling member and is arranged in the container in such a way that in the case of a movement of the swivelling member oriented about the vertical container axis the extraction element which is operatively connected to the same can be moved back and forth relative to the inner wall of the container.

The apparatus in accordance with the invention allows covering relatively large areas of the inner wall of the container with a relatively low expenditure of force and thus to also remove or avoid possible accumulations in bulk materials with critical flow properties. The apparatus can also be built into containers of already existing discharging systems without any major effort.

Further features of the invention are provided from the description below in conjunction with the drawing and the individual patent claims.

BRIEF DESCRIPTION OF THE DRAWING

Embodiments of the invention are described below by reference to the enclosed drawings, wherein:

FIG. 4 shows three-dimensionally a first embodiment of a swivelling member for the apparatus for the removal of accumulations of bulk material as arranged in the container in accordance with FIG. 2 and FIG. 3;

FIG. 5 shows a fixing device for an extraction element which is operatively connected with the swivelling member, which fixing device is arranged on the inner wall of the container and is shown in a top view;

FIG. 6 shows the fixing device for the extraction element which is operatively connected with the swivelling member, which fixing device is shown in a projection along line VI—VI in FIG. 5;

FIG. 7 shows three-dimensionally a locking apparatus for the container with slide-in elements which are laterally pulled out;

FIG. 8 shows in a top view two slide-in elements for the locking apparatus pursuant to FIG. 7 which are provided with a pass-through opening;

FIG. 9 schematically shows in a top view a discharge housing for the container in accordance with FIG. 2;

FIG. 11 shows a section of the elongated extraction element with clamping elements which are arranged on the same in the axial direction at a distance from one another and are each provided with saw-tooth projections;

FIG. 12 shows a relieving body for distributing the bulk material that can be filled into the container, which body is arranged on the swivelling member in accordance with FIG. 4 or FIG. 4A.

DETAILED DESCRIPTION OF PREFERRED EMBODIMENTS

Figure 1:
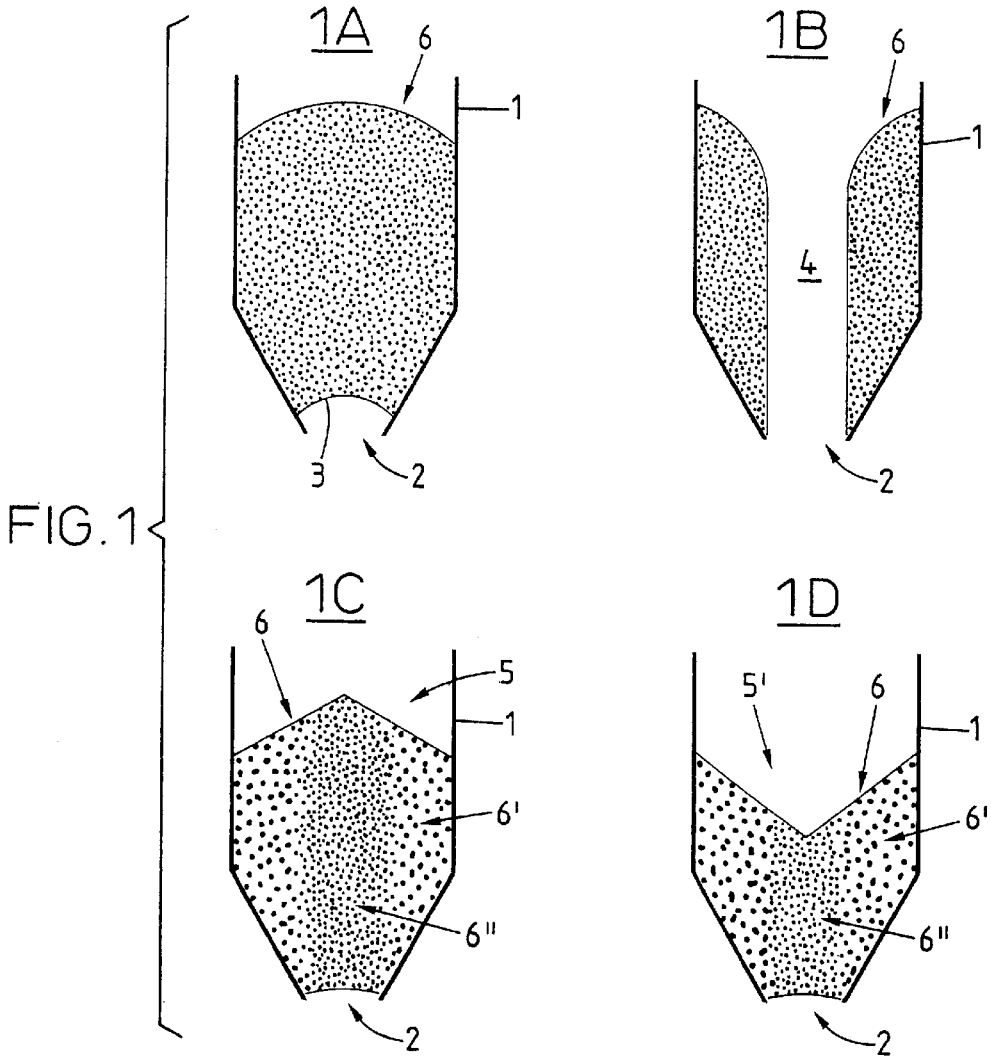
FIG. 1 shows individual, schematically shown material accumulations which are formed according to FIGS. 1A to 1D during the bunkering or during the introduction of bulk materials into container.

For the purpose of generally illustrating and explaining the problem to be solved, embodiments of individual accumulations of bulk material are shown schematically. This may occur when bunkering powdery or granular materials.

The accumulations can occur during the charging of the container automatically without any outside influences and will frequently only be noticed when the discharge of the bunkered material is partly or completely blocked. In order to achieve a perfect and continuous discharge of material, the accumulations are manually removed from the container wall with respective means and at least comminuted to such an extent that the discharge of the comminuted material through an opening, which may be arranged at the bottom of the container, is ensured. The opening can be closed off by an apparatus which is provided with a respective arrangement. The FIGS. 1A to 1D designate the container with reference numeral 1, the opening with 2 and the accumulated bulk material with 6.

FIG. 1A shows by way of an example an accumulation of the bulk material 6 in container 1 which has formed in the form of a relatively stable arch 3 above the opening 2 and occludes the same approximately in the shape of a bridge. Such a bridge formation is obtained particularly in the case of coarse-grained materials where an interlocking connection of the granular particles can occur.

FIG. 1B shows an accumulation of the bulk material 6 which adheres to the inner side walls of container 1 and comprises a shaft 4 which is formed centrally above the opening 2 and corresponds in its cross section approximately to the opening 2. It is also possible that as a result of the special properties of the bulk material there will be different arrangements such as accumulations with a structure which is not exclusively perpendicular, as a result of which the side walls of the container are additionally stressed by deflection in a disadvantageous manner.

During the collapse of such formed bridges 3 or shafts 4 which are shown schematically in FIG. 1A and FIG. 1B it is also possible that as a result of a respective compassion of the bulk material that falls into potential cavities, new bridges or the like are produced which impair the flow of the bulk material. It is additionally possible that the falling material that entrains the air will fall from the container like a liquid (water) for example and thereby damage the outlet elements arranged in the lower zone of the container with a respective undesirable development of dust.

Moreover, during the filling of container 1 it is also possible to obtain so-called bulk material cones 5 or 5' with an approximately convex shape in accordance with FIG. 1C or a concave shape in accordance with FIG. 1D. It is also possible that a division of the bulk material according to grain sizes or grain density will be obtained. The coarse grain particles 6' can reach the outer area of container 1, whereas the fine-grained material 6" accumulates in the form of a shaft in the center. During the emptying of the container the fine-grained bulk material will be discharged first in a disadvantageous manner, and then the coarse-grained one.

Figure 2:
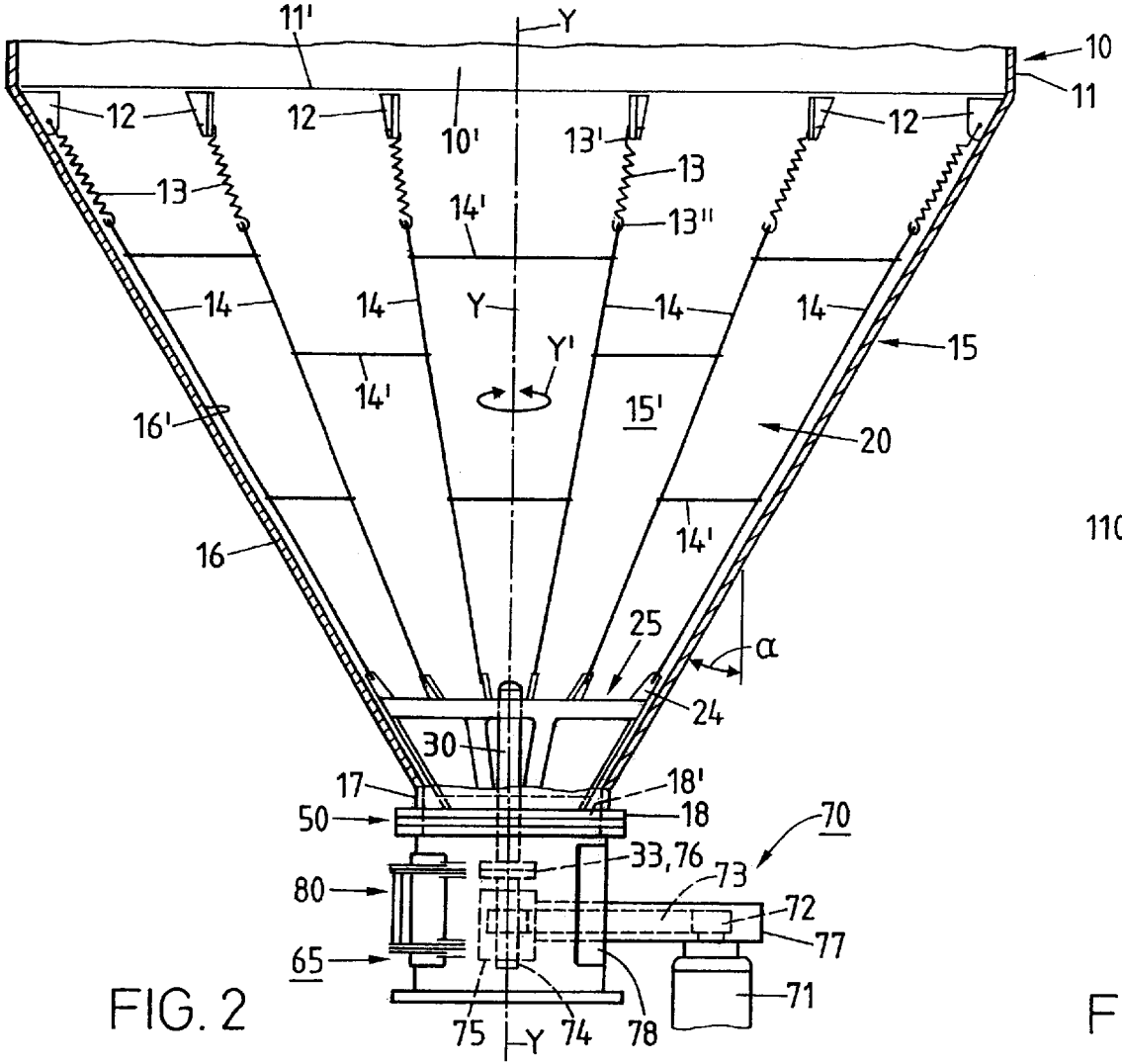
FIG. 2 shows as a first variant and in a sectional view a section of a container with an apparatus for removing accumulations of bulk material which is arranged in the same and is operatively connected with a drive.

FIG. 2 shows as a first variant a section of a container 10 with the inner chamber 10' shown in a sectional view. The container 10 is provided for example with a section 15 which is provided with an arrangement which tapers conically in the direction of a pass-through opening 18'. A cylindrical section 17 is arranged on and fastened to the conical section 15 on the outlet side and a flange 18 which is provided with the pass-through opening 18'. A locking apparatus 50 is further arranged on the flange 18, and on said locking apparatus a discharge housing 65 which is arranged for receiving and holding a drive unit 70.

The drive unit 70 shown schematically in FIG. 2 substantially comprises a motor 71 which by way of a first shaft 72, a drive chain 73 which is operatively connected to the same and is arranged in a gear box 77 is operatively connected to a second shaft 74 held in a head piece 75. Other drive means such as a drive belt (not shown), a toothed rod or the like can be used instead of chain 73. A first flange 76 is arranged on the second shaft 74 which is operatively connected by way of a second flange 33 and a shaft 30 with a swivelling member 25 which is arranged on the outlet side in the inner chamber 15' of the conical section 15. The drive unit 70 is arranged and is provided on the discharge housing 65 in such a way that the swivelling member 25 as well as an extraction apparatus 20, which is operatively connected with the same and is formed by several extraction element 14, are rotatable about a vertical axis Y in the direction of arrow Y' and are preferably movable back and forth in an oscillating manner. The discharge housing 65, which is arranged for installing and holding the drive unit 70, will be explained below in connection with FIG. 9.

For eliminating and removing a possible accumulation of the bulk material as described above in connection with FIGS. 1A to 1D, the extraction apparatus 20 is arranged the container 10, preferably in the inner chamber 15' of the conical section 15. As is shown in FIG. 2, the extraction apparatus 20 comprises the swivelling member 25 arranged in the lower outlet-side zone of the inner chamber 15' as well as several elongated extraction element 14. The individual extraction element 14 which acts resiliently in the longitudinal direction is detachably fastened with the one end to a fixing device 12 which is provided with a respective arrangement and is arranged on the inner side 16' of wall 16. The individual extraction element 14 is detachably fastened with the other end either directly on the swivelling member 25 or a suspension member 24 which is arranged on the same.

As is shown further schematically in FIG. 2, several fixing devices 12 which are arranged in the circumferential direction at a distance from one another are arranged on the inner side 16' in the transitional region 11' from the cylindrical wall 11 to the conical wall 16 and are fastened with means that are not shown. One extraction element 14 is detachably fastened to each fixing device 12. In the embodiment shown in FIG. 2 the extraction elements 14 are fastened to the associated fixing device 12 by interposing a spring element 13. The spring element 13 is hooked into fixing device 12 with a first shaped hook element 13' and connected with a second hook element 13" with the respectively arranged end of the extraction element 14. The individual extraction elements 14 are arranged and held on the fixing devices 12 and the swivelling member 25 so that they are arranged at a distance, preferably at a parallel distance, from the inner side 16' of wall 16 of the conical section 15.

In the embodiment as shown in FIG. 2, a relatively flexible wire cable or the like is provided as an extraction element 14, which cable is fastened with the one end to fixing device 12 by interposing spring 13 and with the other end on the swivelling member 25 by means of the securing member 24. The swivelling member 25 can be moved back and forth in an oscillating manner by the assigned drive unit 70 about the vertical axis Y in the direction of arrow Y' which is common to the container 10 and the conical section 15.

Notice shall be taken that a rope or the like which is extensible to a limited extent with respect to its length and which returns automatically to its original length as a result of its elasticity can be used as an elongated extraction element 14. It is further possible that a chain (not shown in closer detail) is provided as an extraction element 14, e.g. a steel chain, which is fastened with the one end, by interposing spring 13, to fixing device 12 and with the other end to the swivelling member 25 which can be moved back and forth in an oscillating manner about the vertical axis A in the direction of arrow Y'.

As is shown further in FIG. 2, it is also possible that the individual extraction elements 14 which are oriented in the longitudinal direction of the inner side 16' of the wall 16 are mutually connected through several intermediate members 14' which are arranged at a distance from one another. The individual extraction elements 14 and intermediate members 14' form an extraction apparatus 20 which covers the entire inner jacket surface of the conical section 15 in an approximately net-like manner.

In a further embodiment pursuant to FIG. 11, several clamping elements 19 which are arranged at a distance from one another in the longitudinal direction are arranged on the elongated extraction elements 14 of the individual extraction apparatus 20,120 or 220 (FIGS. 2,3,4A) and are fastened with means which are not shown. The individual clamping element 19 is provided with laterally projecting projections 19', 19" which are provided with a saw-tooth arrangement for example and which are used to comminute an accumulation of material in the inner chamber or in the conical section 15,115,215 of the container 10,110 or 210 for discharging purposes.

Figure 2A:
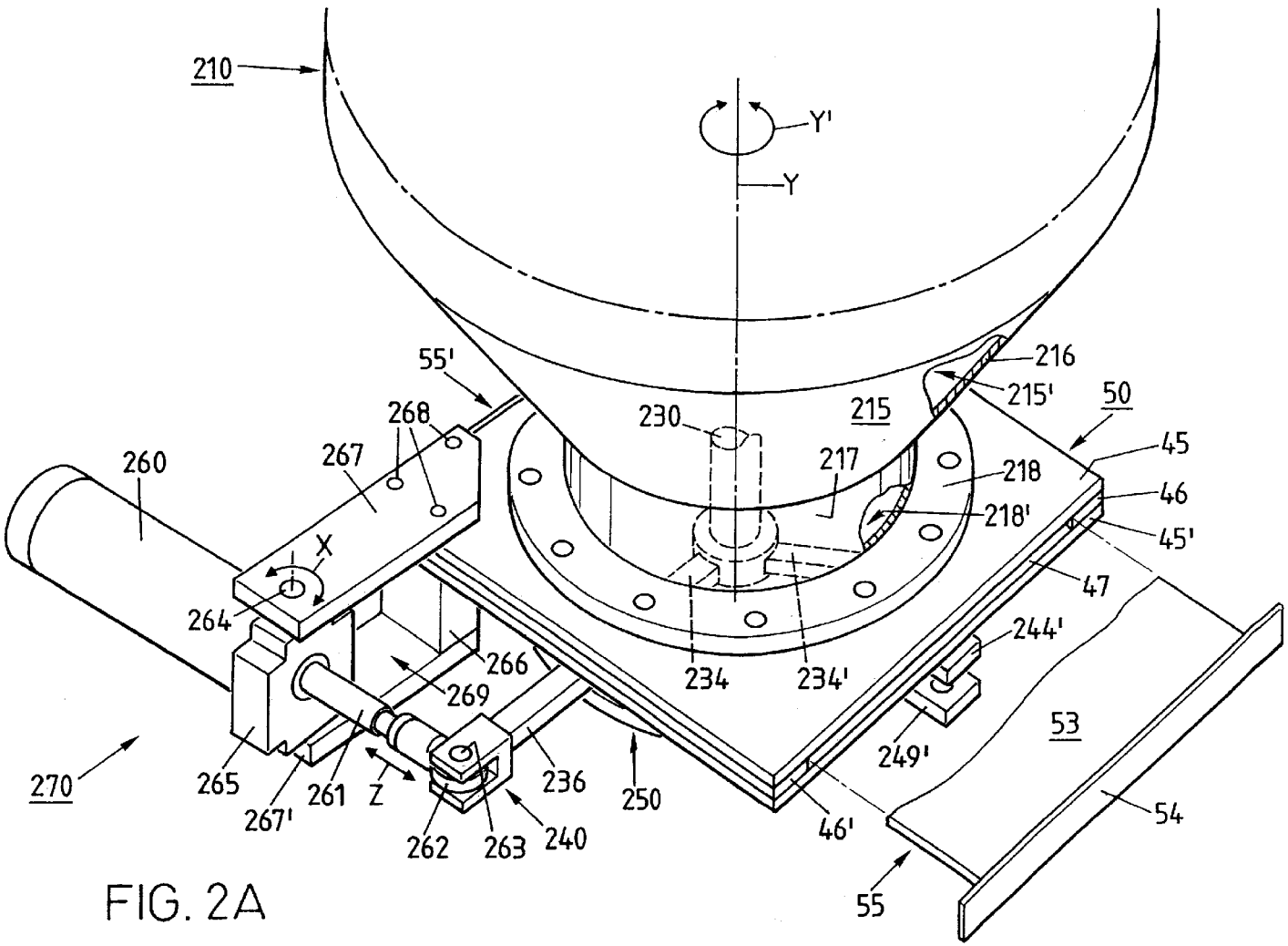
FIG. 2A shows as a second variant and three-dimensionally on an enlarged scale a section of a container with assigned drive for the apparatus for removing accumulations of bulk material which is operatively connected to said drive.

FIG. 2A shows as a second variant and three-dimensionally a section of a container 210 which comprises a section 215 which tapers conically in the direction of a pass-through opening 218'. The section is shown in FIG. 2A in a manner as being partly open and one can see the inner chamber 215' and the wall 216. A cylindrical section 217 and, adjacent to the same, a flange 218 are arranged on the conical section 215. A locking apparatus 50, which comprises the parts 45,45' and 46,46' as well as 53,54,55 and 55', is fastened to the flange 218, which locking apparatus will be described below in detail on the basis of FIGS. 7 and 8.

FIG. 2A further shows a drive unit 270 which is operatively connected to a swivelling apparatus 250 which is arranged below the locking apparatus 50 and is shown here only in part. The swivelling apparatus 250 is in operative connection by way of a shaft 230 with a swivelling member 225 (FIG. 4A) which is arranged in the inner chamber 215' of the conical section 215.

Figure 4A:
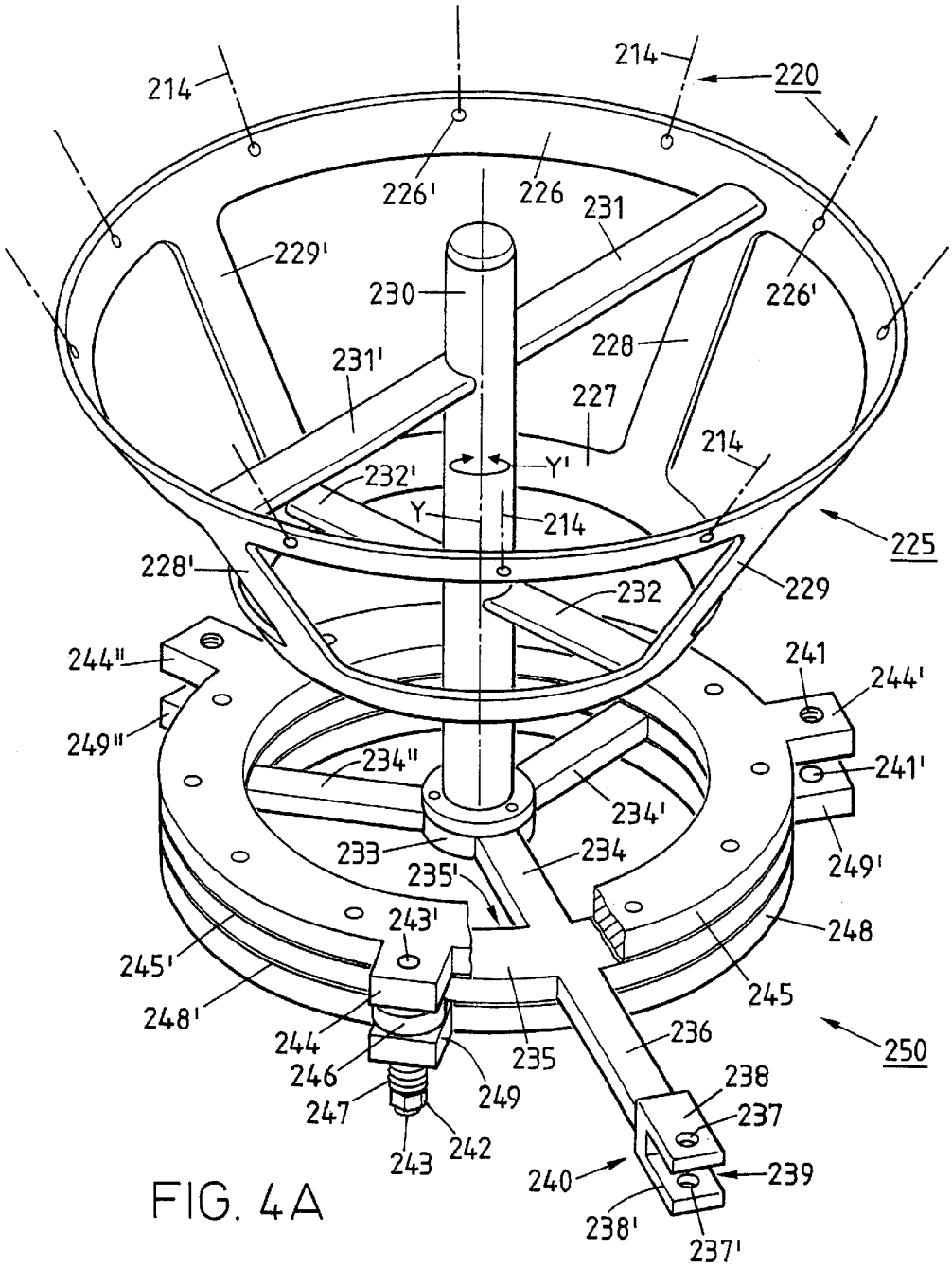
FIG. 4A shows three-dimensionally a second embodiment of the swivelling member for the apparatus for removing accumulations of bulk material as arranged in the container in accordance with FIG. 2A.

The drive unit 270 shown in FIG. 2A comprises a drive member 260 which is held in a block element 265 and is provided with a piston 261. At the forward free end of the piston 261, which is displaceable according to the double arrow Z depending on pressurization, there is a arranged a bearing element 262 which is operatively connected with a fork-shaped piece 240 of the swivelling apparatus 250 through a first hinge bolt 263. The fork-shaped piece 240 is arranged at the forward end of a swivelling lever 236 which is substantially operatively connected with the shaft 230 which is arranged coaxially in the inner chamber 215' of the conical section 215 and with swivelling member 225 (FIG. 4A). The block element 265 which is provided and arranged for bearing the drive member 260 is arranged between two carriers 267 and 267' distanced by an intermediate space 269 and is swivellable in the horizontal direction about the vertical axis (not shown) of a second hinge bolt 264 according to the direction of the double arrow X. The first carrier 267 for the drive member 260 is fastened by means of screw connections 268 to the upper plate 45 and the second carrier 267' is fastened together with an intermediate part 266 in a manner not shown here to the lower plate 45' of the locking apparatus 50.

In a further embodiment of the drive unit 270 it is possible that a toothed rod or the like is arranged for power transmission at the front end of the drive unit 260 on the piston 261. The toothed rod (not shown in closer detail) is in operative connection with an external toothing (not shown) of the swivelling apparatus 250 which is provided on a control ring 235 (FIG. 4A). As a result of the movement of piston 261 oriented in the direction of double arrow Z and of the toothed rod which is tangentially in engagement with the control ring 235, the swivelling member 225 (FIG. 4A) which is arranged in the inner chamber 215' of the conical section 215 can be moved back and forth about the vertical axis Y of shaft 230 in the direction of arrow Y'.

Notice shall be taken that further embodiments of the drive elements for the transmission of power to the swivelling member 225 (FIG. 4A) which is movable back and forth about the vertical axis Y shall also lie within the field of the present invention.

Figure 3:
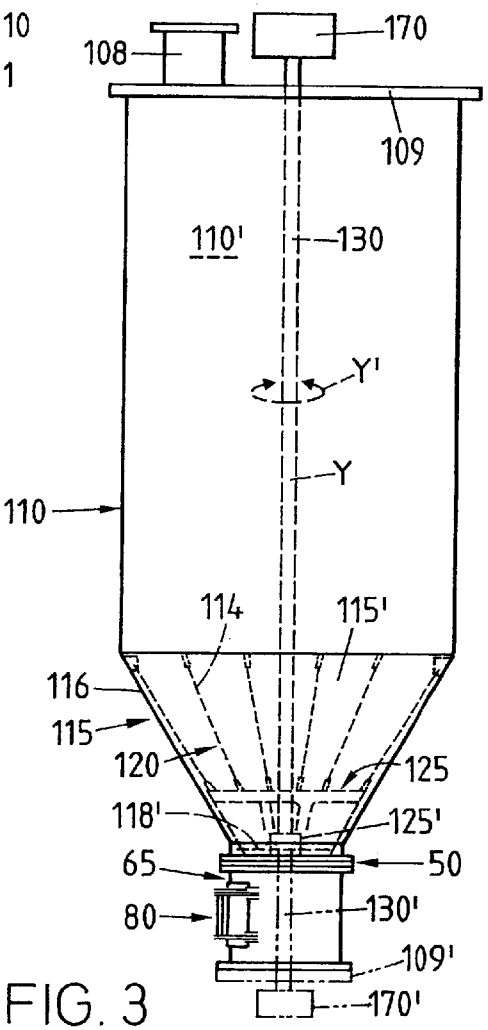
FIG. 3 shows a container as a third variant with a drive arranged at the top and/or bottom for the apparatus for the removal of accumulations of bulk material which is operatively connected to said drive.

FIG. 3 shows as a further embodiment a schematically shown container 110 which substantially comprises the conical section 115 provided with wall 116 and the extraction apparatus 120 which is arranged in the inner chamber 115' of the same. The extraction apparatus 120 is arranged substantially in analogy with the extraction apparatus 20 described above in connection with FIG. 2 and is provided with several extraction elements 114 which are arranged mutually distributed in the circumferential direction. Departing from the embodiment according to FIG. 2, the drive unit 170 is arranged at the top on the cover flange 109 of the container 110 in the variant according to FIG. 3. A filler neck 108 is arranged on the flange 109 which is fastened to container 110 with means that are not shown. A swivelling member 125 is arranged in the outlet side of the conical section 115 which is provided with an outlet opening 118'. Departing from the swivelling member 25 according to FIG. 2, the swivelling member 125 is provided with a schematically shown coupling element 125'. The drive unit 170 which is arranged on the top of the cover flange 109 is operatively connected with the coupling element 125' of the swivelling member 125 by way of a shaft 130 penetrating the inner chamber 110', 115' of the container 110,115 in the axial direction. The swivelling member 125 and the extraction apparatus 120 which is operatively connected with the same is movable back and forth approximately in an oscillating manner in the direction of arrow Y' about the vertical axis Y of shaft 130. The locking apparatus 50 (FIGS. 7,8) arranged on the outlet side on the undesignated flange of the conical section 115 as well as the discharge housing 65 (FIG. 9) are arranged in analogy to the embodiment as shown in FIG. 2, for example.

In a further variant as shown schematically in FIG. 3 it is also possible that the drive unit 170' is arranged below on the discharge housing 65 which is provided with the cover flange 109'. The drive unit 170' is operatively connected with the coupling element 125' of the basket-like swivelling member 125 through a shaft 130' which penetrates the discharge housing 65 in the vertical direction. The discharge of the bulk material occurs here through a lateral outlet opening which is provided on the side of the discharge housing 65 for example.

It is further possible that the extraction apparatus 120 which is arranged in the container 110 with the conical section 115 is synchronously driven in an oscillating manner back and forth by the two drive units 170 and 170' about the common vertical axis Y in the direction of arrow Y' through the shaft 130 and 130 which is operatively connected with the same. This variant is used particularly in cases where relatively high forces are required for dissolving the accumulations of bulk material.

FIG. 4 shows three-dimensionally the swivelling member 25 as a first embodiment for the extraction apparatus 20 arranged in the conical section 15 of container 10. The swivelling member 25, which is arranged substantially in the shape of a basket and is conically tapering in the direction of the pass-through opening 18' (FIG. 2), comprises a first circular ring 26 and a second circular ring 27 arranged at a distance from the first ring, with the second ring 27 having a diameter which is smaller than that of the first ring 26. The two rings 26 and 27 are mutually connected through at least two bridges 28,28' which are arranged diametrically opposite with respect to one another. In the illustrated embodiment the rings 26,27 are mutually connected by means of several bridges 28,28' and 29,29' which are arranged at the same distances from one another. Starting out from the first larger ring 26 in the direction of the second smaller ring 27 the bridges 28,28' and 29,29' have an angle of inclination $\alpha'$ which is preferably arranged in analogy to the angle of inclination a of wall 16 of the conical section 15 (FIG. 2). The first ring 26 is further provided with holes 26' which are arranged in a distributed manner over the circumference and are arranged for receiving the suspension member 24 (FIG. 2). Shaft 30 is arranged coaxially in the swivelling member 25 at the upper end by two first struts 31,31' fastened to the first ring 26 and at the lower end by two struts 32,32' which are fastened to the second ring 27. At the lower end the shaft 30 is in operative connection with the belt or chain 73 of the drive unit 70 by means of the two flanges 33,67 and the head piece 75 (FIG. 2).

FIG. 4A shows three-dimensionally a second embodiment of the swivelling member 225 for the apparatus 220 for removing accumulations of bulk material, which apparatus is arranged in the container 210 according to FIG. 2A and is provided with extraction elements 214. The swivelling member 225 is arranged substantially in analogy to the swivelling member 25 which has been described above in connection with FIG. 4. The first ring 226 can be recognized which is provided with the holes 226' which are arranged at a distance from one another. One can further recognize the second ring 227 which is arranged at distance from the first ring, the bridges 228,228' and 229,229' as well as shaft 230. Shaft 230 is operatively connected with the upper ring 226 by means of the first struts 231,231' and by means of second struts 232,232' with the lower ring 227.

Departing from the first embodiment of the swivelling member 25 in accordance with FIG. 4, the second embodiment of the swivelling member 225 in accordance with FIG. 4A comprises a swivelling apparatus 250 consisting of several elements. The swivelling apparatus 250 comprises a circularly arranged control body 235 which is arranged between an upper ring body 245 and a lower ring body 248. The control body 235 and the two ring bodies 245 and 248 are preferably provided with a seal 245',248' at the mutually facing sliding surfaces. Furthermore, the two ring bodies 245 and 248 can be connected and mutually sealed by way of an annular tongue-and-groove joint (not shown) with the annular control body 235. The control ring 235 is operatively connected with shaft 230 of the swivelling member 225 by means of carrier arms 234,234' and 234" which are arranged on the inner side 235' and are distributed over the circumference and by means of a hub element 225 which is connected to the same. The swivelling lever 236 is arranged on the outer circumference of the control ring 235 which is connected through the fork-shaped piece 240 which is fastened on the same with the bearing element 262 arranged on the piston 261 of the drive member 260 (FIG. 2A). The fork-shaped piece 240 comprises two sections 238,238' which are distanced by an intermediate space 239 and are each provided with a bore 237,237' for the hinge pin 263.

Brackets 244,244',244" and 249,249',249" which are distributed over the outer circumference are provided on the two ring bodies 245 and 248. The upper brackets 244,244', 244" of the first ring body 245 for example are provided with a threaded bore 241 (only illustrated once), with the lower brackets 249,249',249" of the second ring body 248 each being provided with a through bore 241' (only illustrated once). An intermediate member arranged as a roller element, preferably a roller bearing 246 (only illustrated once), is arranged between the individual brackets 244,244',244" and 249,249', 249" of the two ring bodies 245 and 248. The roller bearing 246 is held in a bolt 243 rotatably about its vertical axis (not shown in further detail). The bolt 243 is screwed with its upper end 243' into the threaded bore 241 of the bracket 244. At the lower end of the bolt a pressure spring 247 is arranged which rests on the lower bracket 249 and is held by a nut 242. As a result of the roller bearings 246 which are arranged in a distributed manner in the circumferential direction between the two ring bodies 245 and 248, the control ring 235 which is operatively connected with the shaft 230 and the swivelling member 225 is arranged coaxially to the ring bodies 245 and 248 and can be moved back and forth precisely by means of shaft 230 about the vertical axis Y of the same in the direction of arrow Y'.

FIG. 12 shows a swivelling member 25',125',225' in a side view as a further embodiment which is arranged in analogy to the swivelling member in accordance with FIG. 4 or in analogy to the swivelling member 225 in accordance with FIG. 4A. Departing from the swivelling member 25,125,225 in accordance with FIG. 4 or FIG. 4A, the swivelling member 25',125' or 225' in accordance with FIG. 12 is additionally provided with a relieving body 23. The relieving body 23, which is arranged in a conical manner for example, is preferably arranged on the two upper struts and is fastened to the same in a manner which is not illustrated herein. It is also possible in a variant which is not shown herein in closer detail that the relieving body 23 is operatively connected with the shaft 30 (FIG. 2) or 230 (FIG. 4A) which is movable approximately in an oscillating manner back and forth about the vertical axis Y in the direction of arrow Y' and is connected to the same in a manner not illustrated herein.

FIGS. 5 and 6 show a fixing device 40 for the individual extraction element 14,114,214 of the extraction apparatus 20,120,220, which fixing device is arranged on the inner side 16' of wall 16. FIG. 5 shows the fixing device 40 in a top view and in FIG. 6 in accordance with line VI—VI of FIG. 5 in a side view. The fixing device 40, which is described below in detail, can be installed instead of the fixing devices 12 and the spring 13 (FIG. 2) for resiliently fastening the individual extraction elements 14,114,214. The fixing device 40 comprises a supporting element 30 which is provided with a U-shape in the profile cross section for example, a bearing element 38 which is arranged adjacent to the same and is provided with a thread 38' and a spring element 35. The spring element 35 is arranged on the bearing element 38 with a cylindrical section 36 consisting of several windings and is secured by a disc 41 and by a screw 42 which is screwed into the thread 38' of the bearing element 38. The spring element 35 is plugged into and held in a bore 39' provided on the carrying strap 39 with a bent end element 36'. The other section of the spring element 35 is arranged as an elongated spring arm 36" which is arranged at the end disposed at a distance to the bearing element 38 as a bent eye 37 for hanging in the individual extraction element 14,114, 214. The spring element 35 can be removed easily from the bearing element 35 by loosening screw 42 and removing disc 41 for the purpose of exchanging the same.

In a variant not illustrated herein the carrying element 39 is provided with a thread corresponding to screw 42 and the bearing element 38 is provided with a pass-through bore (not illustrated) through which screw 42 can be guided and is screwed into a thread of the carrying element 39. In this variant it is possible that by loosening the screw 42 the parts 41, 35 and 38 of the carrier part 39 which is fastened to the inner side 16' of the wall 16 by a welded connection for example can be dismounted.

FIG. 7 shows in a three-dimensional illustration the locking apparatus 50 which is arranged on the outlet side on flange 18 of the conical section 15,115 or 215. The locking apparatus 50 comprises an upper as well as a lower plate 45 and 45' which are penetrated by an opening 48 arranged in the center. The two plates 45 and 45' are arranged at a distance from one another by two intermediately disposed intermediate elements 46 and 46' which are arranged in strips in such a way that a gap-like intermediate space 47 is provided between the plates 45 and 45'. A respectively arranged locking element 55 and 55' can be inserted into the intermediate space 47 from either side. One can further see in FIG. 7 bores 49 which are arranged at a distance from one another and penetrate the two plates 45 and 45' and bolts 44 which are arranged on the upper plate 45 at a distance from one another.

In the embodiment shown in FIG. 7 the two locking elements 55 and 55' are each provided with a handle 54 and 54' which are arranged on the face side of plate 53 and 53'. An arc-shaped recess 52 and 52' is arranged on each of the face sides 51 and 51' of the two plates 53 and 53', which recesses are arranged in analogy to the outer diameter of shaft 30,130 or 230. In the inserted state of the two locking elements 55 and 55' the two recesses 52 and 52' enclose the shaft 30,130 or 230 in such a way that the opening 48 of the locking apparatus 50 which corresponds to the pass-through opening 18',118' or 218' is closed.

FIG. 8 shows two further locking elements 60 and 60' for the locking apparatus 50 which are each provided with a plate 59, 59' and with a handle 57,57' arranged on the same. A semi-circular recess 58',58" is arranged in each of the two plates 59,59'. In the inserted state of the two locking elements 60, 60' the mutually facing face sides 61,61' of the two plates 59,59' rest opposite of one another, so that the two semi-circular recesses 58',58" mutually form an opening 58 corresponding with the pass-through opening 18', 118' or 218' for the discharge.

FIG. 9 schematically shows the discharge housing 65 for the container 10 (FIG. 2) or container 110 (FIG. 3) and one can recognize a hollowcylindrically arranged housing body 66 where a flange 69 and 69' each is arranged on and fastened to the upper and lower end, respectively. The housing body 66 is provided laterally with a first recess 67 and on the opposite side with a second recess 68. The first recess 67, which is provided for controlling the pass-through opening 18' and for mounting the drive unit 70 for example, can be closed by a shutter 81 and can be locked in this position (FIG. 8) by a suitable closing device 80. In the illustrated embodiment the shutter 81 is swivellably arranged and held on the housing body 66 by means of respectively arranged hinge members 83,83' and 85,85' of the closing device 80.

The second recess 68 is arranged for introducing and mounting the head piece 75 (FIG. 2) which is in connection with the drive member 73 and is arranged in the inner chamber 66' of the housing body 66. The drive unit 70, which is partly illustrated in FIG. 9, is arranged on the cylindrical housing body 66 with a holding plate 78 and by fastening means (not shown). The holding plate 78 for the drive unit 70 is further arranged for closing the second recess 68 and is arranged according to the outer cylindrical shape of the housing body 66.

Figure 10:
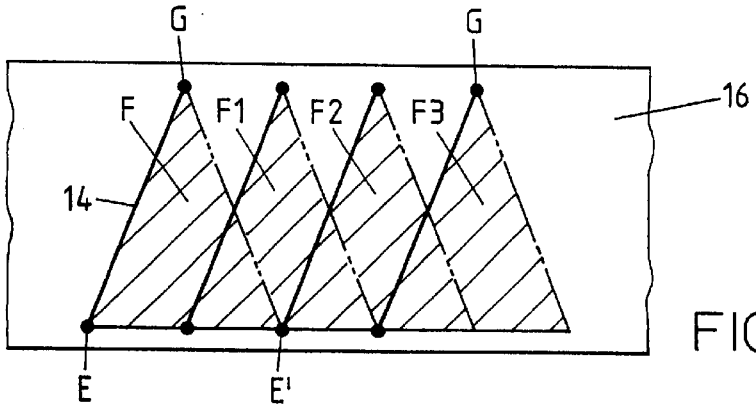
FIG. 10 shows schematically in a developed view a section of the container wall with the extraction elements for removing the accumulations of bulk material which are individually arranged on said wall and on the swivelling element pursuant to FIG. 5.

For the purpose of explaining the function and operation of the individual extraction elements 14 (without spring 13) which are in connection with the swivelling member 25 (not shown) FIG. 10 shows the extraction apparatus 20 as a schematic developed view, with E showing the connection position of the elongated extraction element 14 on the swivelling member 25 (FIG. 2) and with G showing the fastening position on the fixing device 40 (FIGS. 5,6) and with E' showing the swivelled connecting position E.

As a result of the movement of the swivelling member 25 about the vertical container axis Y (FIG. 1) the individual extraction element 14 is swivelled about the substantially fixed connecting position G from E to E' and covers in this process the respective shaded triangular surface area F, F1, F2 and F3 on the inner side 16' of wall 16. During the swivelling of the plurality of extraction elements 14 the individual, partly overlapping triangular surface areas F, F1, F2 and F3 are touched and thus an optimal extraction and removal of the accumulations of bulk material formed in the container 10 or the conical section 15 are achieved.

The function and operation of the extraction elements 114 according to FIG. 3 which are operatively connected with the swivelling member 125 or the extraction elements 214 according to FIG. 4A which are operatively connected with the swivelling member 225 occur in analogy to the function of the extraction elements 14 arranged on swivelling member 25 as has been described in connection with FIG. 10.

The extraction system as illustrated and described above in connection with the individual figures is not limited to the aforementioned embodiments. Further appropriate embodiments are also possible without departing from the basic idea of the invention (removal of accumulations of bulk material in a container). This relates in particular to the function, embodiment and arrangement of the individual resiliently suspended extraction elements 14, 114 or 214.

What is claimed is:

1. A container device for breaking up bulk material comprising:

a container having a conical tapering section and a locking apparatus in a zone of a discharge opening;

at least one extraction element disposed resistantly adjacent an inner wall of the container; and a swiveling member disposed in the zone of the discharge opening and operatively connected by means of a shaft to a drive unit and oriented about the vertical container axis; and wherein a first end of the said extraction element is disposed at a distance to the outlet opening and another end of the said extraction element is operatively connected to the said swiveling member such that when moved relative to the inner wall of the container the swiveling member is brought into engagement with the extraction element for back and forth movement relative to the inner wall of the container.

2. The apparatus as claimed in claim 1, wherein the swiveling member is configured in a conically tapering manner corresponding to the conical section of the container and approximately in the shape of a basket; and wherein the shaft is co-axially disposed in and operatively connected with the swiveling member.

3. The apparatus as claimed in claim 2, wherein the swiveling member has a first ring having a diameter and a second ring at a distance therefrom having a diameter less than that of the first ring and wherein several bridges mutually connect the two rings under an angle of inclination $\alpha$ and with an angle of inclination $\alpha'$ of the individual bridges analog an angle $\alpha$ of the conical section of the container.

4. The apparatus of claim 3, wherein the locking apparatus disposed at the conically tapering section has an opening and comprises two mutually insertable locking elements each provided with a semi-circular recess, such that when in an inserted state they rest in a sealing manner on the shaft.

5. The apparatus of claim 4, wherein the locking elements each are provided with semicircular recesses that are corresponding to the opening of the locking apparatus which is in connection with the discharge opening of the conical section.

6. The apparatus of claim 3, wherein the shaft is operatively connected to the swiveling member by means of struts which are fastened to said shaft and to the first and second rings.

7. The apparatus of claim 1, wherein the swiveling member comprises a relieving body, which is configured in a conical shape oriented in the direction of the supply of bulk material.

8. The apparatus of claim 1, wherein the conically tapering section of the container is provided with a plurality of extraction elements circumferentially disposed at a distance from each other and wherein the first end of each of the extraction elements is disposed at a fixing element disposed at the inner wall of the container by means of a spring element, and the other end of each extraction member disposed at the swiveling member.

9. The apparatus as claimed in claim 1, wherein an extraction apparatus is formed of individual extraction elements configured for corresponding in a net-like manner to an inner jacket surface of the conically tapering section of the container by means of intermediate members which mutually connect said extraction elements, and wherein the movement of the swiveling member about the vertical container axis causes a back and forth movement of the extraction apparatus relative to the inner wall of the container.

10. The apparatus as claimed in claim 9, wherein the extraction elements are provided along their longitudinal extension with a plurality of clamping elements having lateral projections for realizing a frictional, scratching or excavating action.

11. The apparatus of claim 1, wherein the extraction element is made from a flexible wire cable capable of being extended and retracted due to its elasticity.

12. The apparatus of claim 1, wherein a discharge housing is provided at one of the locking apparatus or a second conical section, said housing configured for holding a drive unit in operative connection with the shaft by means of a coupling element for causing a back and forth movement of the swiveling member.

13. The apparatus of claim 1, wherein the swiveling member disposed at the conical section is movable in a back and forth movement together with the extraction element by means of a drive unit disposed at one of each a top end of the container or a bottom end of the discharge housing and which is in operative connection with the shaft.

14. The apparatus of claim of claim 1, wherein a control ring which is in operative connection with the shaft is disposed below the location of the swiveling member and is movable in a back and forth movement together with the swiveling member about the vertical axis of the shaft through a swiveling lever which is fastened to said control ring and is in operative connection with a piston of a drive member.

15. The apparatus of claim 14, wherein the control ring is provided at an outer circumference with a toothing, and wherein a piston of the drive member is provided with a toothed rod and tangentially in engagement with the toothing such that the swiveling member and the shaft are movable in a back and forth movement about the vertical axis of the shaft.

16. The apparatus of claim 15, wherein the toothing is a segment-like outer toothing.

17. The apparatus of claim 15, wherein a control ring is disposed co-axially between two corresponding ring bodies, that are provided with brackets arranged correspondingly and at a distance to one another on the outer circumference of the ring bodies and which are mutually connected by studs with the control ring, and wherein the control ring is movable relative to a common vertical axis of the shaft.

18. The apparatus of claim 16, wherein a sliding body is held between the brackets by the studs for abutment with the outer circumference of the control ring.

19. The apparatus of claim 17, wherein an annular seal is provided between mutually facing sliding surfaces of the two ring bodies and the control ring.

20. A method for breaking up accumulations of powdery or granulated bulk material compacted in a container comprising the steps of:

resistantly disposing in an inner chamber of the container at least one extraction element in approximately axial direction of the same;

providing a first end of the said extraction element above of and at a distance to a discharge opening on the inner wall of the container;

connecting another end of the extraction element to a swiveling member;

moving the said swiveling member disposed in the zone of the discharge opening about a vertical container axis and breaking up and comminuting the accumulated material through engagement of the said swiveling member with the material;

moving the said at least one extraction element relative to the inner wall of the container and thereby discharging the comminuted material, so that the swiveling member in operative connection with the at least one extraction member is swiveling back and forth about the vertical container axis relative to the inner wall of the container.

21. The method of claim 20, wherein during the steps of comminuting and discharging the bulk material, several extraction elements which are mutually distributed in circumferential direction are in action, each extraction element being disposed with the first end thereof on the inner wall of the container and each being connected with the second end to the swiveling member.

22. The method of claim 20, wherein the steps of comminuting and discharging the bulk material, a plurality of extraction elements are mutually connected in a net-like manner and are being disposed each with the first end thereof on the inner wall of the container and each being operatively connected with another end thereof to the swiveling member.

23. The method of claim 20, wherein extracting and comminuting of the accumulations of bulk material is effected through a frictional scratching and excavating action by the extraction element during the movement of the swiveling member.

* * * * *